US010036614B1

(12) United States Patent
Ruiz

(10) Patent No.: US 10,036,614 B1
(45) Date of Patent: Jul. 31, 2018

(54) QUICK RELEASE MECHANISMS TO ATTACH ACCESSORIES TO FIREARMS

(71) Applicant: George Ruiz, Hacienda Heights, CA (US)

(72) Inventor: George Ruiz, Hacienda Heights, CA (US)

(73) Assignee: AIM Sports Inc., Ontario, CA (US)

( * ) Notice: Subject to any disclaimer, the term of this patent is extended or adjusted under 35 U.S.C. 154(b) by 0 days.

(21) Appl. No.: 15/418,710

(22) Filed: Jan. 28, 2017

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
CPC ..... F41G 11/00; F41G 11/003; F41G 11/004; F41G 1/38; F41G 1/387; F41A 35/00; F41C 27/00
See application file for complete search history.

(56) References Cited

U.S. PATENT DOCUMENTS 2,824,504 A 2/1958 Bethmann
4,845,871 A 7/1989 Swan
5,276,988 A 1/1994 Swan
5,390,419 A 2/1995 Sirkis
5,570,529 A * 11/1996 Amelino ..... F41G 11/003 42/124
5,787,630 A 8/1998 Martel
6,435,738 B1 8/2002 Vogt
6,442,883 B1 * 9/2002 Waterman ..... F41G 11/003 42/124
6,637,144 B2 10/2003 Nelson et al.
7,107,716 B1 * 9/2006 Liao ..... F41C 27/00 42/108
7,219,370 B1 * 5/2007 Teetzel ..... A42B 3/04 2/422
7,272,904 B2 9/2007 Larue
7,562,485 B2 * 7/2009 Newhall ..... F41G 11/003 42/124
7,614,175 B2 * 11/2009 Davis ..... F41G 11/003 42/124
7,739,824 B1 6/2010 Swan
7,823,316 B2 11/2010 Storch et al.
7,905,045 B1 * 3/2011 Swan ..... F41G 11/003 403/374.5
7,908,782 B1 * 3/2011 LaRue ..... F41G 11/003 42/124
8,336,246 B1 * 12/2012 Barber ..... F41G 11/003 42/124
8,336,247 B2 * 12/2012 Haering ..... F41G 11/003 42/111
8,578,647 B2 11/2013 Storch et al.
8,671,610 B2 * 3/2014 Kincel ..... B65D 45/00 292/245
9,194,659 B2 * 11/2015 Oglesby ..... F41G 11/001
9,328,998 B2 5/2016 Volfson
9,464,863 B2 * 10/2016 Mather ..... F41C 23/14
9,568,281 B1 * 2/2017 Chen ..... F41A 23/10
(Continued)

*Primary Examiner* — Derrick R Morgan
(74) *Attorney, Agent, or Firm* — Stahl Law Firm

(57) ABSTRACT

The present invention relates to quick release mechanisms to attach accessories to firearms. Quick release mechanisms of the present invention can be used to attach scopes, sights, lights, lasers, launchers, bipods, grips, and other accessories to firearms.

19 Claims, 19 Drawing Sheets

(56) References Cited

U.S. PATENT DOCUMENTS 9,752,853 B2 * 9/2017 Teetzel ..... F41G 1/35
2006/0117636 A1 6/2006 Newhall et al.
2006/0207156 A1 * 9/2006 Larue ..... F41G 11/003 42/127
2007/0234623 A1 * 10/2007 Carney ..... F41G 11/003 42/95
2008/0092421 A1 * 4/2008 Beckmann ..... F41G 11/003 42/90
2008/0216380 A1 * 9/2008 Teetzel ..... F41G 11/003 42/127
2010/0031553 A1 * 2/2010 Couture ..... F41G 11/003 42/90
2011/0146128 A1 * 6/2011 Haering ..... F41G 11/003 42/90
2011/0247255 A1 * 10/2011 Ding ..... F41G 11/003 42/90
2012/0181406 A1 * 7/2012 Gonzalez ..... F41G 11/003 248/316.2
2012/0272557 A1 * 11/2012 Yan ..... F41C 23/12 42/69.01
2013/0055610 A1 3/2013 Watkins
2013/0055614 A1 3/2013 Finnegan et al.
2013/0156495 A1 * 6/2013 Li ..... F41G 11/003 403/322.4
2013/0333184 A1 * 12/2013 Couture ..... F41G 11/003 29/428
2014/0157648 A1 * 6/2014 Haering ..... F41G 11/003 42/125
2015/0260482 A1 9/2015 Volfson
2016/0102943 A1 * 4/2016 Teetzel ..... F41G 1/35 42/113
2016/0102946 A1 * 4/2016 Sharron ..... F41G 11/003 42/90
2017/0045334 A1 * 2/2017 Yim ..... F41G 11/003

* cited by examiner

QUICK RELEASE MECHANISMS TO ATTACH ACCESSORIES TO FIREARMS

1.0 FIELD OF THE INVENTION

The invention relates to quick release mechanisms to attach accessories to firearms.

2.0 BACKGROUND

Mounting systems are used to attach accessories to firearms, and those accessories may be scopes, sights, lights, lasers, launchers, bipods, grips, and other accessories. During the use of a firearm, it may be necessary to add, remove, reposition, or change an accessory on a firearm. A mounting system should facilitate the attachment of an accessory to a firearm so that a stable connection is established throughout the use of the firearm. Also, a mounting system should facilitate the attachment and removal procedure for an accessory to and from a firearm to be simple and fast, so that it can be carried out even in the dark and preferably with the least possible need for tools, and preferably without the need for any tools.

A release mechanism to quickly, reversibly, firmly and safely attach firearms accessories to a firearm would be useful. The present invention describes such quick release mechanisms.

3.0 SUMMARY OF THE INVENTION

The present invention relates to quick release mechanisms to attach accessories to firearms. In certain embodiments, quick release mechanism of the current invention comprises a cam-lever, a pivot, a latch, a clamp, a clamp spring, and/or a tension screw, or some of these components.

In certain embodiments, a cam-lever of the current invention comprises a cam-portion and an arm-portion. In certain embodiments, a cam-portion of a cam-lever of the current invention comprises a cam-cutout. In certain embodiments, a pivot of the current invention fits inside a cam-cutout of a cam-lever of the current invention. In certain embodiments, a pivot of the current invention can link to a tension screw of the current invention, for example through a threaded opening in the pivot and fitting the tension screw.

In certain embodiments, an arm-portion of a cam-lever of the current invention comprises an inner cavity. In certain embodiments, a cavity of an arm-portion is open on an end of the arm-portion, preferably an end that is distal from a cam-portion. In certain embodiments, an inner cavity of an arm-portion of a cam-lever contains a spring, for example a compression spring or an extension spring. In certain embodiments, an inner cavity of an arm portion of a cam-lever is closed with a screw, for example a set screw. In certain embodiments, an arm-portion of a cam-lever of the current invention comprises an opening through the arm-portion and/or an opening in a wall of an inner cavity of the arm-portion, and preferably in two walls. More preferably, two openings in two walls of an arm-portion are arranged opposite of each other, and more preferably, both openings are of equal size, diameter, and/or length or substantially equal size, diameter, and/or length. In certain embodiments, an opening in an arm-portion of a cam-lever of the current invention comprises a slot.

In certain embodiments, a latch of the current invention comprises an inner cavity. In certain embodiments, a cavity of a latch comprises a size and shape to allow inserting an arm-portion of a cam-lever of the invention, and preferably to provide a close fit with an arm-portion while allowing movement of the arm-portion in the cavity of the latch. In certain embodiments, a cavity of a latch is open on two opposite ends, preferably to allow insertion of an arm-portion of a cam-lever on one end of the latch, but not on the other end of the latch. In certain embodiments, an arm-portion can be inserted into one end of a cavity of a latch of the invention, but it cannot be moved past a point inside the cavity of the latch, and it cannot be move through the latch.

In certain embodiments, a latch of the current invention can be moved along an arm-portion that is inserted into the inner cavity of the latch. In certain embodiments, movement of a latch along an arm-portion is counteracted by a spring, for example a compression spring or an extension spring. In certain embodiments, a spring in an inner cavity of an arm-portion counteracts movement of a latch of the current invention.

In certain embodiments, a latch of the current invention comprises a finger. In certain embodiments, a finger of a latch of the current invention can be used to secure the latch in a position, preferably a position next to a clamp of the current invention, preferably by inserting a wall of a clamp between a finger and a body of a latch.

In certain embodiments, a latch of the current invention comprises an opening through the latch and/or an opening in a wall of an inner cavity of the latch, and preferably an opening in each of two walls and preferably with both openings arranged opposite of each other, and preferably with both openings of equal size, diameter, and/or length or substantially equal size, diameter, and/or length. In certain embodiments, a latch of the current invention is located on an arm portion of a cam-lever of the current invention.

In certain embodiments, a pin extends through a latch of the current invention, preferably through openings in walls of an inner cavity of the latch. In certain embodiments, a pin extends through a latch and an arm-portion in an inner cavity of the latch, preferably through openings in walls of the latch and the arm-portion.

In certain embodiments, a clamp of the current invention is capable of binding, pressing, and/or pushing against a clamping-object comprising a firearm, a mount for a firearm, an accessory for a firearm, and/or a part for a firearm. In certain embodiments, a clamp of the current invention comprises a clamp spring. In certain embodiments, a clamp spring of the current invention is capable of modulating the proximity between a clamp of the current invention and a clamping-object. In certain embodiments, a clamp of the current invention comprises a clamp cut-out. In certain embodiments, a finger of the current invention can fit in and/or through a clamp cut-out of the current invention, for example, so that movement of a cam-lever of the current invention is restricted.

In certain embodiments, a tension screw of the current invention fits in a pivot of the current invention. In certain embodiments, a tension screw of the current invention extends through a clamp of the current invention. In certain embodiments, a tension screw of the current invention extends through a clamping-object.

4.0 BRIEF DESCRIPTION OF THE DRAWINGS

The present invention will be better understood by reading the Detailed Description of the various embodiments with reference to the accompanying figures. The appended figures are included solely for purposes of illustrating a few of the many embodiments of the current invention. It is understood that multiple embodiments of the current invention are not shown in the appended figures but are within the scope of the current invention.

Figure 10:
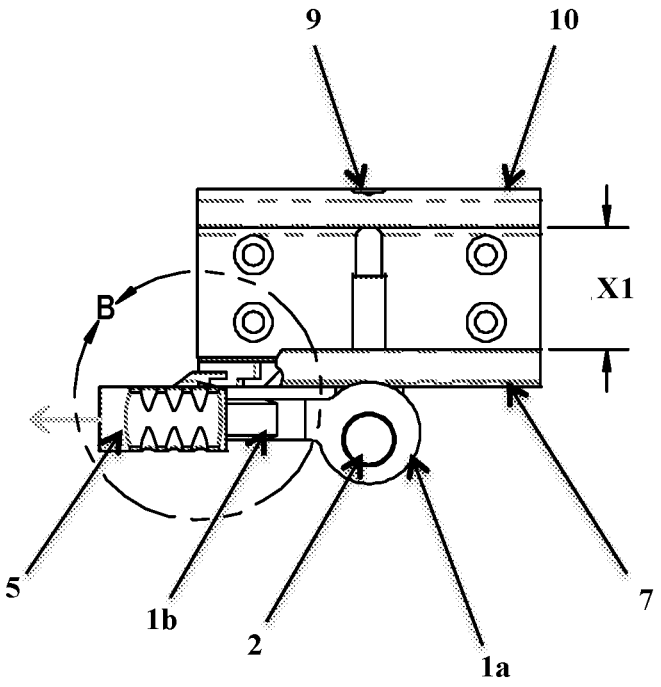

FIG. 10 shows a bottom view of a quick release mounting system according to certain embodiments of the invention, with parts of the clamp 7 not shown to reveal the interaction of the latch 5 with the clamp 7, and a mount for a firearm 10.

Figure 11:
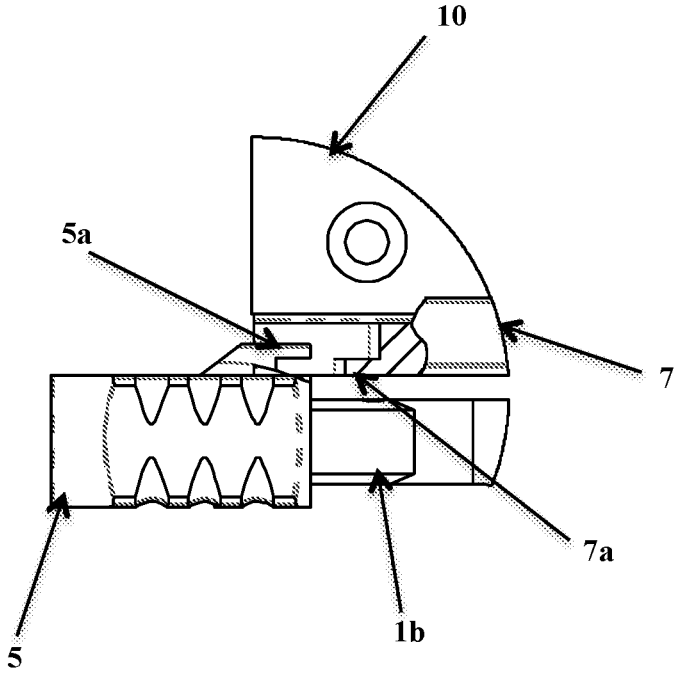

FIG. 11 shows the callout in circle B in FIG. 10.

FIGS. 12-15 show bottom views of a quick release mounting system according to certain embodiments of the invention and a mount for a firearm 10.

Figure 16:
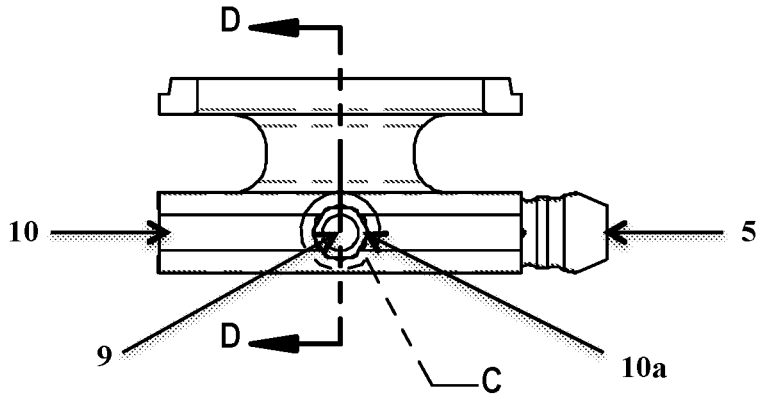

FIG. 16 shows parts of a quick release mounting system according to certain embodiments of the invention, when seen as emerging from behind a mount for a firearm 10.

Figure 17:
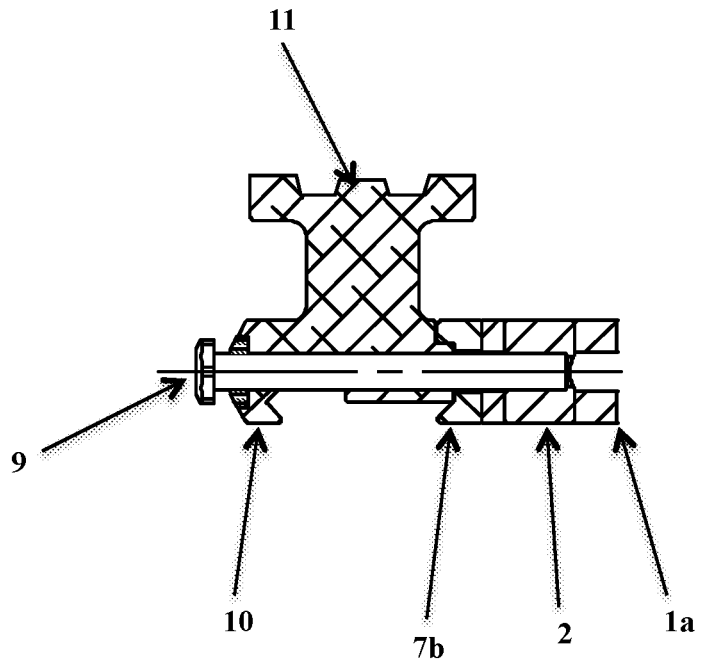

FIG. 17 shows the cross-sectional view along line D-D in FIG. 16, including a mount for a firearm (10 and 11).

Figure 18:
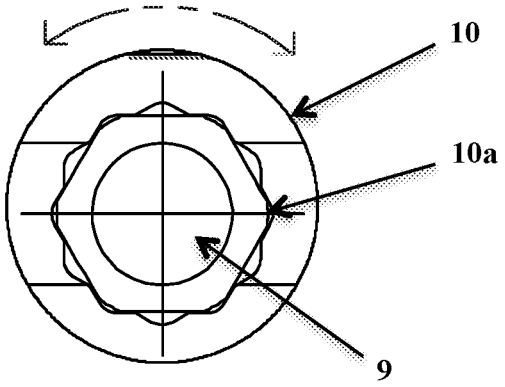

FIG. 18 shows the callout in circle C in FIG. 16.

Figure 19:
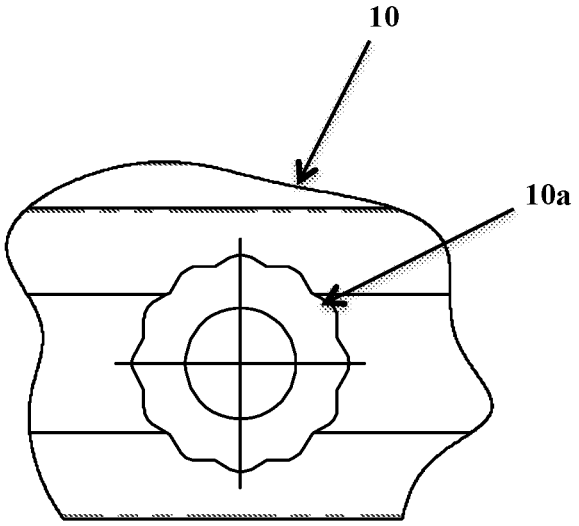

FIG. 19 shows a section of a mount for a firearm 10 for use with a quick release mounting system according to certain embodiments of the invention.

5.0 DETAILED DESCRIPTION OF THE INVENTION

The present invention relates to quick release mechanisms to attach accessories to firearms. In certain embodiments, a quick release mechanism of the current invention comprises a cam-lever, a pivot, a latch, a clamp, a clamp spring, and/or a tension screw, or some of these components.

In certain embodiments, a cam-lever of the current invention is capable of exerting varying levels of pressure on a clamp of the current invention. In certain embodiments, a cam-lever of the current invention is capable of exerting varying levels of pressure on a clamp by varying the orientation of the cam-lever relative to the clamp. In certain embodiments, a cam-lever of the current invention is capable of exerting varying levels of pressure on a clamp by rotating the cam-lever, for example, by rotating the cam-lever about an axis of a pivot of the current invention but without, or substantially without, the clamp rotating about said axis of a pivot.

In certain embodiments, a cam-lever of the current invention is capable of moving a clamp of the current invention, for example, by increasing the distance of said clamp to a pivot of the current invention. In certain embodiments, a cam-lever of the current invention is capable of moving a clamp of the current invention, for example, by varying the orientation of the cam-lever relative to the clamp. In certain embodiments, a cam-lever of the current invention is capable of moving a clamp of the current invention, for example, by rotating the cam-lever, for example, by rotating the cam-lever about an axis of a pivot of the current invention but without, or substantially without, the clamp rotating about said axis of a pivot.

In certain embodiments, a cam-lever of the current invention comprises a cam-portion and an arm-portion. In certain embodiments, a cam-portion and/or an arm-portion may be made of one piece, in certain other embodiments, a cam-portion and/or an arm-portion may be made of more than one piece, for example, two, three, four, five, or more pieces.

In certain embodiments, a cam-portion of a cam-lever of the current invention comprises one cam piece, or two cam pieces, or three cam pieces, or four cam pieces, or five cam pieces, or 5 to 10 cam pieces, or 1 to 5 cam pieces, or 1 to 3 cam pieces, or 2 to 3 cam pieces. In certain embodiments, some or all cam pieces of a cam-portion of the current invention may be connected to each other and/or they may be made of one piece, and/or they may be made of two pieces, or three pieces, or each cam piece of a cam-portion may be made of one piece. In certain embodiments, cam pieces of a cam-portion of the current invention are arranged parallel to each other, and preferably with the cam functions of all cam pieces aligned.

In certain embodiments, a cam-portion of a cam-lever of the current invention comprises a cam-cutout. In certain embodiments, a cam-cutout of a cam-portion of the current invention is located to result in a cam function and/or cam shape of the cam-portion. In certain embodiments, a cam-cutout of a cam-portion of the current invention is off-center to result in a cam function and/or cam shape of the cam-portion. In certain embodiments, a cam-cutout is an opening that can be generated in any way, for example, by removing material during and/or after making a cam-portion, and/or by generating a cam-portion with a cam-cutout.

In certain embodiments, a cam-lever of the current invention can be rotated, for example, a cam-lever can be rotated about an axis. In certain embodiments, a cam-lever of the current invention can be rotated about an axis of a pivot of the invention. In certain embodiments, a cam-portion of the current invention can be rotated, for example, a cam-portion can be rotated about an axis. In certain embodiments, a cam-portion of the current invention can be rotated about an axis of a pivot of the invention. In certain embodiments, an arm-portion of the current invention can be rotated, for example, an arm-portion can be rotated about an axis. In certain embodiments, an arm-portion of the current invention can be rotated about an axis of a pivot of the invention.

In certain embodiments, a pivot of the current invention facilitates a rotation of a cam-lever of the invention. In certain embodiments, an axis of a pivot of the current invention is an axis about which a cam-lever of the invention can rotate. In certain embodiments, a pivot of the invention is close to and/or adjacent to a cam-lever of the invention. In certain embodiments, a pivot of the invention extends through a part of a cam-lever of the invention, for example, through a cam-portion and/or an arm-portion. In certain embodiments, a pivot of the current invention fits inside a cam-cutout of a cam-lever of the current invention. In certain embodiments, a pivot of the current invention can link to a tension screw of the current invention, for example by fitting a tension screw into a threaded opening in a pivot of the invention.

In certain embodiments, an arm-portion of a cam-lever of the current invention comprises a spring, for example, a compression spring and/or an extension spring. In certain embodiments, an arm-portion of a cam-lever of the current invention comprises a screw and/or a cap and/or a lid and/or a closure, for example, to close an opening and/or cavity in the arm-portion, and/or to comprise a stop for a spring, for example a spring of the current invention, for example a spring of an arm-portion of the current invention.

In certain embodiments, an arm-portion of a cam-lever of the current invention comprises an inner cavity. In certain embodiments, a cavity of an arm-portion is open on an end of the arm-portion, preferably an end that is distal from a cam-portion. In certain embodiments, an inner cavity of an arm-portion of a cam-lever contains a spring, for example a compression spring or an extension spring. In certain embodiments, an inner cavity of an arm portion of a cam-lever is closed with a screw, for example a set screw, or with a lid, a cap, and/or a closure. In certain embodiments, an arm-portion of a cam-lever of the current invention comprises an opening through the arm-portion and/or an opening in a wall of an inner cavity of the arm-portion, and preferably in two walls of an inner cavity. More preferably, two openings in two walls of an arm-portion are arranged opposite of each other, and more preferably, both openings are of equal size, diameter, and/or length or substantially equal size, diameter, and/or length. In certain embodiments, an opening in an arm-portion of a cam-lever of the current invention comprises a slot.

In certain embodiments, an arm-portion of a cam-lever of the current invention is hollow, for example, to allow inserting a spring mechanism to counteract movement of a latch of the current invention. In certain embodiments, an arm-portion of a cam-lever of the current invention comprises carve-outs, for example, to allow inserting a spring mechanism to counteract movement of a latch of the current invention.

In certain embodiments, an arm-portion of a cam-lever of the current invention is functionally linked to a spring mechanism, for example, a spring mechanism to counteract movement of a latch of the current invention, and preferably a latch that is capable of sliding on an arm-portion.

In certain embodiments, a latch of the current invention is capable of sliding on a cam-lever of the current invention, preferably on an arm-portion of a cam-lever. In certain embodiments, a latch of the current invention is capable of sliding on a cam-lever of the current invention, with some or more of the cam-lever extending into an opening of the latch, for example, an opening comprising a cavity, a grove, a slot, a gap, and/or a hollow.

In certain embodiments, a latch of the current invention comprises an opening, for example, a cavity, a grove, a slot, a gap, and/or a hollow, and the opening may on the interior and/or a surface of a latch. In certain embodiments, an opening of a latch comprises a size and shape to allow inserting an arm-portion of a cam-lever of the invention, and preferably to provide a close fit with an arm-portion while allowing movement of the arm-portion in the opening of the latch. In certain embodiments, an opening of a latch of the current invention is open on two opposite ends, preferably to allow insertion of an arm-portion of a cam-lever on one end of the latch, but not on the other end of the latch. In certain embodiments, an opening of a latch of the current invention comprises one opening that is smaller than a second opening, so that an arm-portion of the current invention cannot be moved through the smaller opening, but can be moved through the larger opening. In certain embodiments, an arm-portion can be inserted into one end of an opening of a latch of the invention, but it cannot be moved past a point inside the opening of the latch, and it cannot be move through the latch. In certain embodiments, an opening of a latch of the current invention comprises a stop beyond which an arm-portion of the current invention cannot be moved and/or cannot be moved without drastically higher force, for example, force that is at least ten times higher, or at least twenty times higher, or at least thirty times higher, or at least forty times higher, or at least fifty times higher than moving the arm-portion through other parts of the opening.

In certain embodiments, a latch of the current invention can be moved along an arm-portion that is inserted into an opening of the latch. In certain embodiments, movement of a latch along an arm-portion is counteracted by a spring, for example a compression spring or an extension spring. In certain embodiments, movement of a latch along an arm-portion and away from a cam-portion is counteracted by a spring so that the latch is forced back closer towards the cam-portion. In certain embodiments, a spring in an opening of an arm-portion counteracts movement of a latch of the current invention.

In certain embodiments, a spring that is associated with an arm-portion of the current invention counteracts movement of a latch of the current invention. In certain embodiments, a spring is associated with an arm-portion of the current invention by being on and/or next to the arm-portion and/or by being in the arm-portion, for example, by being partially or wholly in the arm-portion.

In certain embodiments, a latch of the current invention comprises a locking mechanism to hold the latch in a desired position, for example, in a locked position wherein the quick release mechanism is not released from an accessory or an unlocked position wherein it is released from an accessory. In certain embodiments, a locking mechanism of a latch of the current invention comprises a finger, a hook, a catch, a fastener, a clip, a snap, a magnet, a button, a staple, a push-button, and/or a clasp. In certain embodiments, a locking mechanism of a latch of the current invention can be used to secure the latch in a position, preferably in a locked position, for example, a position next to a clamp of the current invention. In certain embodiments, a locking mechanism of a latch of the current invention is capable of holding onto a clamp of the current invention, for example, by holding onto a wall of a clamp. In certain embodiments, a locking mechanism of a latch of the current invention comprises a finger capable of holding onto a wall of a clamp of the current invention, for example, by inserting the wall between the finger and a body of a latch.

In certain embodiments, a latch of the current invention comprises an opening through the latch and/or an opening in a wall of an inner cavity of the latch, and preferably an opening in each of two walls and preferably with both openings arranged opposite of each other, and preferably with both openings of equal size, diameter, and/or length or substantially equal size, diameter, and/or length.

In certain embodiments, a latch of the current invention is located on an arm-portion of a cam-lever of the current invention, for example, by inserting the arm-portion into an opening and/or gap of the latch, and preferably to allow the latch to move relative to the arm-portion.

In certain embodiments, a pin extends through a latch of the current invention, preferably through openings in walls of an inner cavity of the latch. In certain embodiments, a pin extends through a latch and an arm-portion in an inner cavity of the latch, preferably through openings in walls of the latch and the arm-portion.

In certain embodiments, a clamp of the current invention is capable of binding, pressing, and/or pushing against a clamping-object, for example, a firearm, a mount for a firearm, an accessory for a firearm, a part for a firearm, a scope, a sight, a light, a laser, a rail, a Picatinny rail, a Weaver rail, and/or any other kind of accessory or mount. In certain embodiments, a cam-lever of the current invention is capable of moving a clamp of the current invention, preferably towards a clamping-object. In certain embodiments, a clamp of the current invention can be pressured towards a clamping-object.

In certain embodiments, a clamp of the current invention comprises a region that is complementary in shape to a cam-portion of the current invention, or substantially complementary thereto, or partially complementary thereto, for example to distribute any friction between a clamp and a cam-portion over a larger surface area. In certain embodiments, a clamp of the current invention comprises an elevation and/or an indentation to facilitate and/or improve a desired orientation of a cam-lever relative to the clamp. In certain embodiments, a clamp of the current invention comprises an elevation that aligns a cam-portion of the current invention, for example, by having a cam piece of the cam-portion rotate next to the elevation and/or by having an elevation between cam pieces of a cam-portion. In certain embodiments, a clamp of the current invention comprises an indentation that aligns a cam-portion of the current invention, for example, by having a cam piece of the cam-portion rotate in the indentation.

In certain embodiments, a clamp of the current invention is capable of binding, pressing, and/or pushing against a clamping-object comprising a firearm, a mount for a firearm, an accessory for a firearm, and/or a part for a firearm. In certain embodiments, a clamp of the current invention comprises a clamp spring. In certain embodiments, a clamp spring of the current invention is capable of modulating the proximity between a clamp of the current invention and a clamping-object. In certain embodiments, a clamp of the current invention comprises a clamp cut-out. In certain embodiments, a finger of the current invention can fit in and/or through a clamp cut-out of the current invention, for example, so that movement of a cam-lever of the current invention is restricted.

In certain embodiments, a tension screw of the current invention fits in a pivot of the current invention. In certain embodiments, a tension screw of the current invention is capable of connecting to a pivot of the current invention, for example, through a threaded connection, a locking pin, a nut, a cap, and/or any known connection.

In certain embodiments, a tension screw of the current invention and a pivot of the current invention are connected through a fixed connection, for example, by welding, fusion, clipping, or any other known method. In certain embodiments, a tension screw of the current invention and a pivot of the current invention are made of one piece and/or are connected through a fixed connection.

In certain embodiments, a tension screw of the current invention and a pivot of the current invention are connected, and the tension screw is comprised of a screw head and/or a nut connected to a bolt, for example, through a threaded connection or any other known connection. In certain embodiments, a tension screw of the current invention comprises a screw head and/or a nut connected and a bolt. In certain embodiments, a screw head and/or a nut connected and a bolt of a tension screw of the current invention comprises are connected, for example, through a threaded connection or any other known connection.

In certain embodiments, a tension screw of the current invention extends through a clamp of the current invention. In certain embodiments, a tension screw of the current invention extends through a clamping-object.

In certain embodiments, a quick release mechanism of the current invention can be made of any known material of sufficient strength, for example, a metal, a light metal, iron, steel, aluminum, magnesium, titanium, an alloy, a plastic, or any other know material. In certain embodiments, different components of a quick release mechanism of the current invention are made of the same material or materials, or they are made of different materials. In certain embodiments, a quick release mechanism of the current invention can be made through any method known in the art that is suited to achieve a desired quality, durability, cost of manufacturing, and any other desired attribute.

Quick release mechanisms according to certain embodiments of the current invention are further exemplified in the figures.

Figure 1:
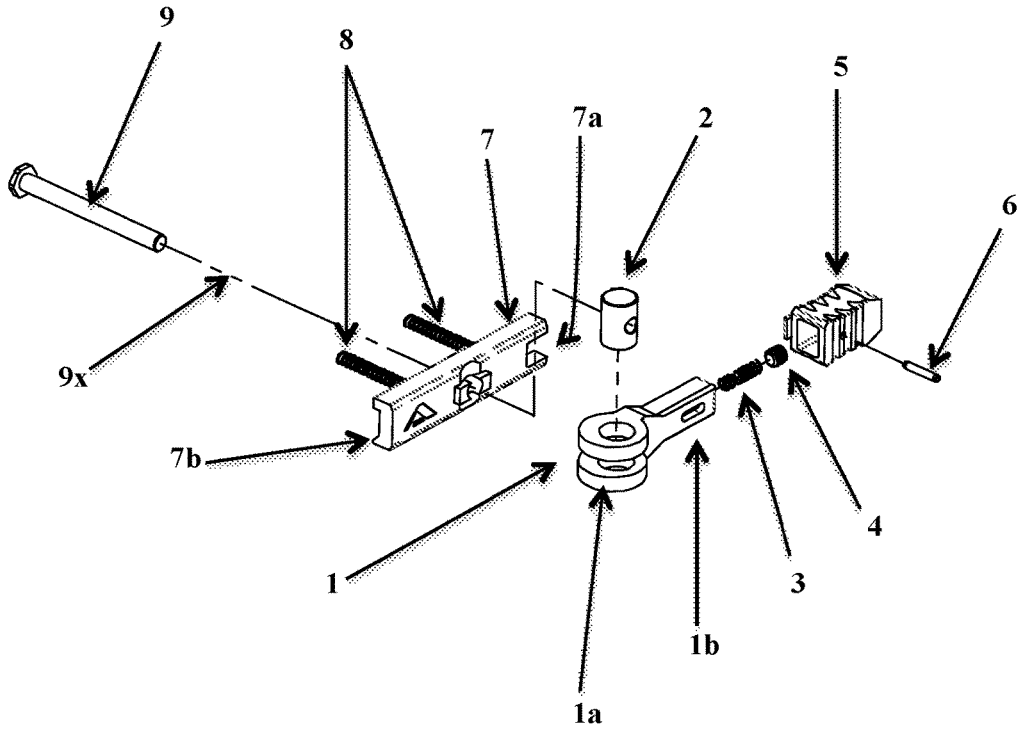
FIG. 1 shows an exploded view of a quick release mounting system according to certain embodiments of the invention.

FIG. 1 shows an exploded view of a quick release mechanism according to certain embodiments of the invention. Shown is a cam-lever 1 comprising a cam-portion 1*a* and an arm-portion 1*b*. A pivot 2 fits in the cam-cutout (pointed to by dotted line below the pivot 2) of the cam-portion 1*a*. A spring 3 fits inside an inner cavity of the arm-portion 1*b* and the inner cavity is closed with a set screw 4. A latch 5 is shown with a finger of the latch 5 appearing on the far-side of it. The arm-portion 1*b* fits inside the inner cavity of the latch 5. A pin 6 is shown that fits through lateral openings of the latch 5 (as pointed out by a line) and through lateral slots in the arm-portion 1*b* (one is shown). A clamp 7 is shown with a clamp cut-out 7*a* and a clamping edge 7*b* and with two clamp springs 8. The clamp 7 is held to the cam-lever 1 with a tension screw 9, which extends along the path shown as 9*x* through an opening in the clamp 7, between the upper and lower cam of the cam-portion 1*a*, and into an opening in the pivot 2.

Figure 2:
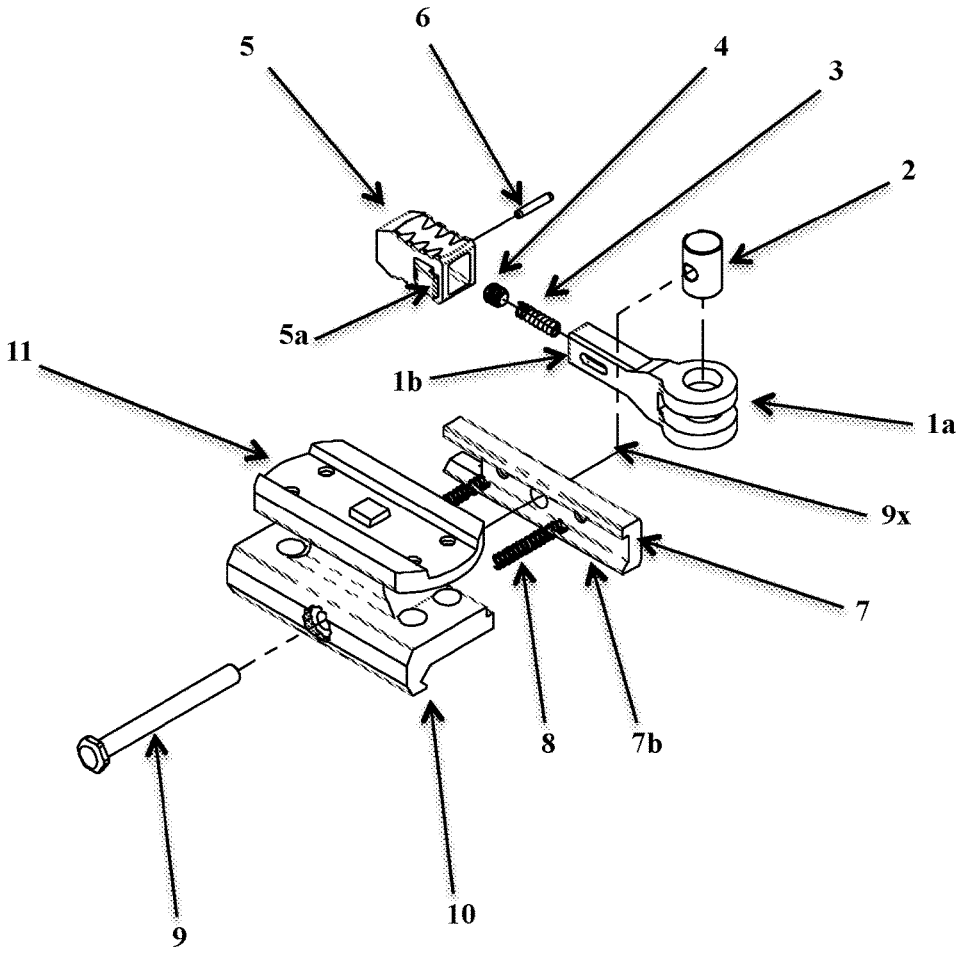
FIG. 2 shows an exploded view of a quick release mounting system according to certain embodiments of the invention and a mount for a firearm (10 and 11).

FIG. 2 shows an exploded view of a quick release mechanism according to certain embodiments of the invention and a mount for a firearm (10 and 11). Shown are a cam-portion 1*a* and an arm-portion 1*b* of a cam-lever 1. A pivot 2 fits in the cam-cutout (pointed to by dotted line below the pivot 2) of the cam-portion 1*a*. A spring 3 fits inside an inner cavity of the arm-portion 1*b* and the inner cavity is closed with a set screw 4. A latch 5 is shown with a finger 5*a* of the latch 5. The arm-portion 1*b* fits inside the inner cavity of the latch 5. A pin 6 is shown that fits through lateral openings of the latch 5 (as pointed out by a line) and through lateral slots in the arm-portion 1*b* (one is shown). A clamp 7 is shown with a clamping edge 7*b* and with two clamp springs 8 (one partially obstructed). The clamp 7 is held to the cam-portion 1*a* with a tension screw 9, which extends along the path shown as 9*x* through an opening in the clamp 7, between the upper and lower cam of the cam-portion 1*a*, and into an opening in the pivot 2. Also shown is a clamping-object, exemplified as a mount for a firearm comprising a top 11 for mounting an accessory and a bottom 10, through which the tension screw 9 runs, and which counteracts the clamp 7.

Figure 3:
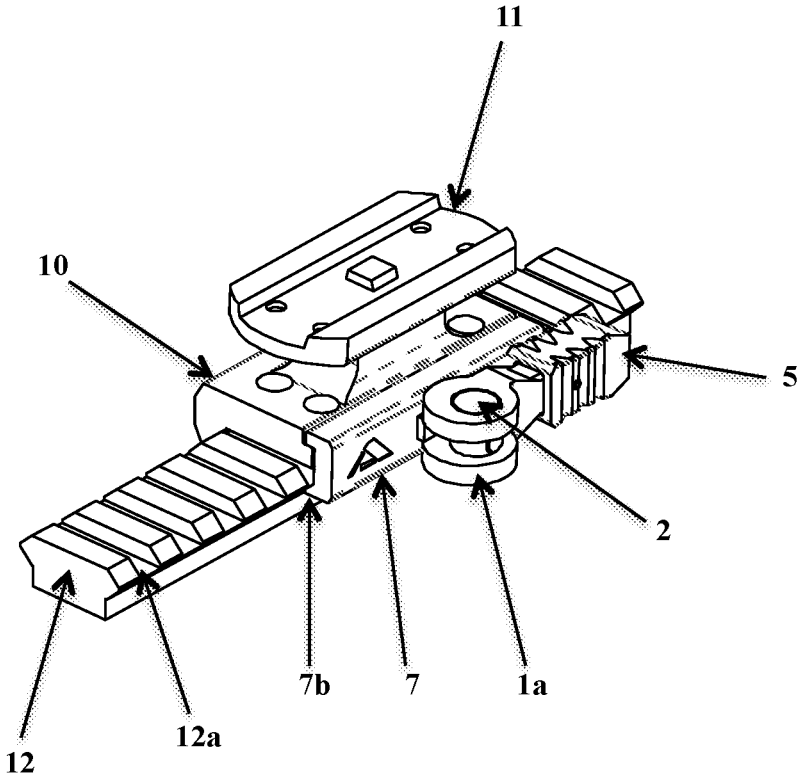
FIG. 3 shows a perspective view of a quick release mounting system according to certain embodiments of the invention and a mount for a firearm (10 and 11) and a rail mount for a firearm 12.

FIG. 3 shows a perspective view of a quick release mechanism according to certain embodiments of the invention and a mount for a firearm (10 and 11) and a rail mount for a firearm 12. Shown is a cam-portion 1*a* and a pivot 2 that fits in the cam-cutout of the cam-portion 1*a*. A latch 5 is shown with the arm-portion 1*b* of the cam-lever 1 inside the inner cavity of the latch 5. The latch 5 is in a locked position so that the quick release mechanism is attached to the mount (10 and 11) and the rail 12. A clamp 7 is shown with a clamping edge 7*b*. Also shown is a clamping-object, exemplified as a mount for a firearm comprising a top 11 for mounting an accessory and a bottom 10, which counteracts the clamp 7. The clamping-object and the quick release mechanism are mounted onto a mounting rail 12 with mounting slots 12*a*. The mounting rail 12 may be a Picatinny rail, a Weaver rail or any other known mounting structure.

Figure 4:
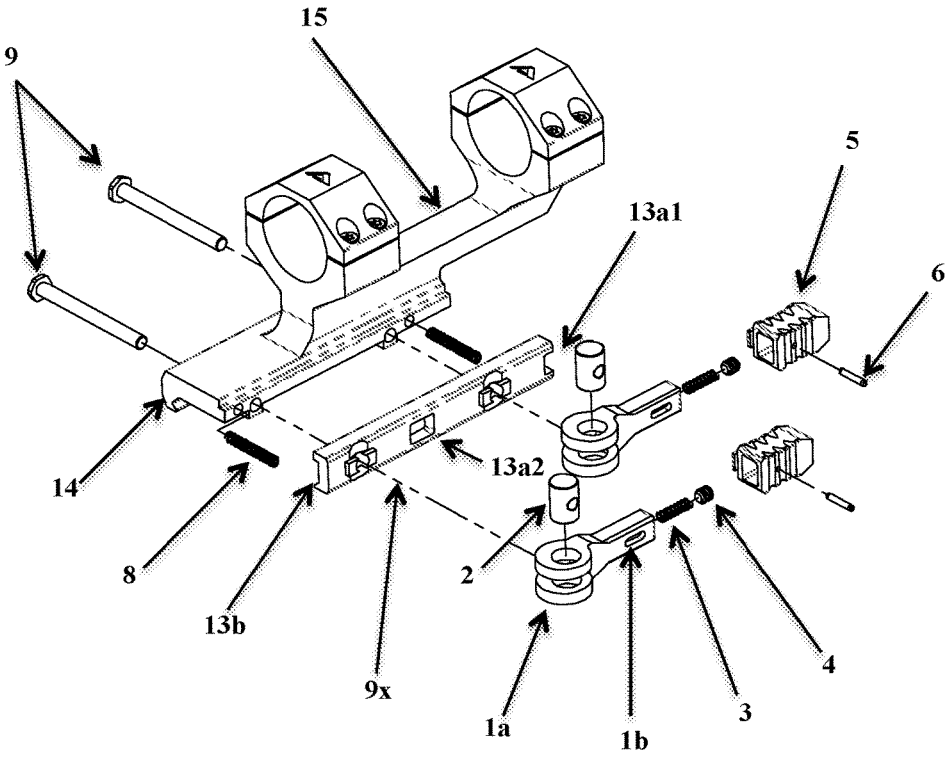
FIG. 4 shows an exploded view of a quick release mounting system according to certain embodiments of the invention and a mount for a firearm (14 and 15).

FIG. 4 shows an exploded view of a quick release mechanism according to certain embodiments of the invention and a mount for a firearm (14 and 15). Shown are two cam-levers, each comprising a cam-portion 1*a* and an arm-portion 1*b*. A pivot 2 fits in the cam-cutout (pointed to by dotted line below the pivot 2) of the cam-portion 1*a* of each cam-lever. A spring 3 fits inside an inner cavity of each arm-portion 1*b* of each cam-lever and the inner cavity of each arm-portion 1*b* is closed with a set screw 4. A latch 5 for each cam-lever is shown with a finger of the latch 5 appearing on the far-side of it. The arm-portion 1*b* of each cam-lever fits inside the inner cavity of the two latches 5. A pin 6 is shown that fits through lateral openings of each latch 5 (as pointed out by a line) and through lateral slots in each arm-portion 1*b* (one slot is shown in each arm-portion 1*b*). A clamp 13 is shown with a clamp cut-out (13*a*1 and 13*a*2) and a clamping edge 13*b* and with two clamp springs 8. The clamp 13 is held to each cam-lever 1 with a tension screw 9, one of which extends along the path shown as 9*x* and the other through the parallel path. Each tension screw 9 extends through an opening in the clamp 13, between the upper and lower cam of the cam-portion 1*a*, and into an opening in each pivot 2. Also shown is a clamping-object, exemplified as a mount for a firearm comprising a top 15 for mounting an accessory (for example, a scope) and a bottom 14, through which each tension screw 9 runs, and which counteracts the clamp 13.

Figure 5:
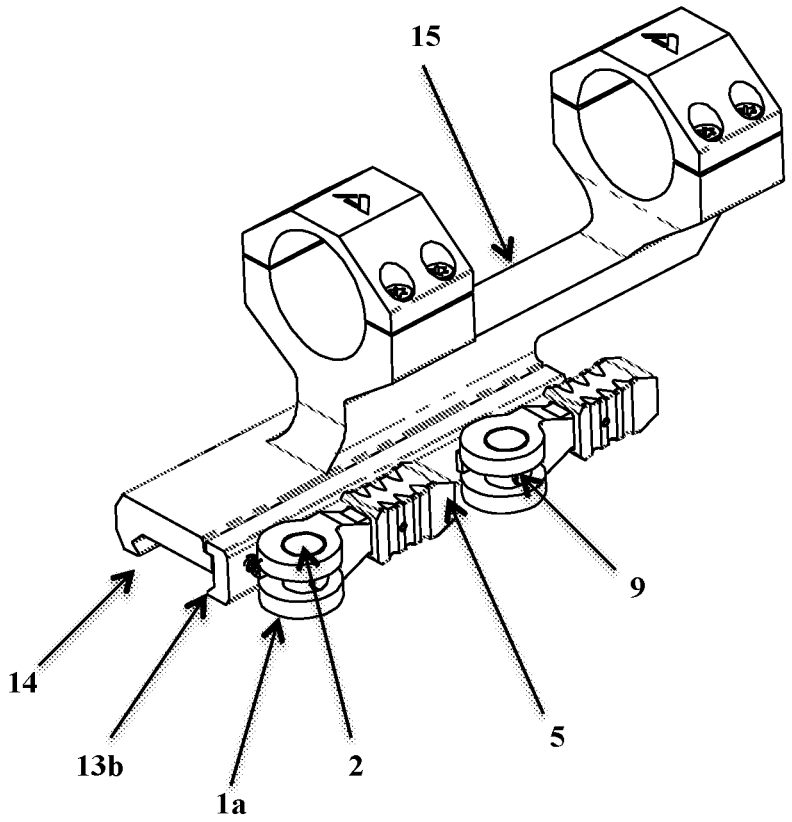
FIG. 5 shows a perspective view of a quick release mounting system according to certain embodiments of the invention and a mount for a firearm (14 and 15).

FIG. 5 shows a perspective view of a quick release mechanism according to certain embodiments of the invention and a mount for a firearm (14 and 15). Shown are two cam-levers, each comprising a cam-portion 1*a* and an arm-portion 1*b* extending inside an inner cavity of a latch 5. A pivot 2 fits in the cam-cutout of the cam-portion 1*a* of each cam-lever. The latch 5 is in a locked position so that the quick release mechanism would be attached to a rail between the mount 14 and the clamp 13 (the clamping edge 13*b* is pointed out). A tension screw 9 extends through each pivot 2, connecting the clamp 13 to the mount 14.

Figure 6:
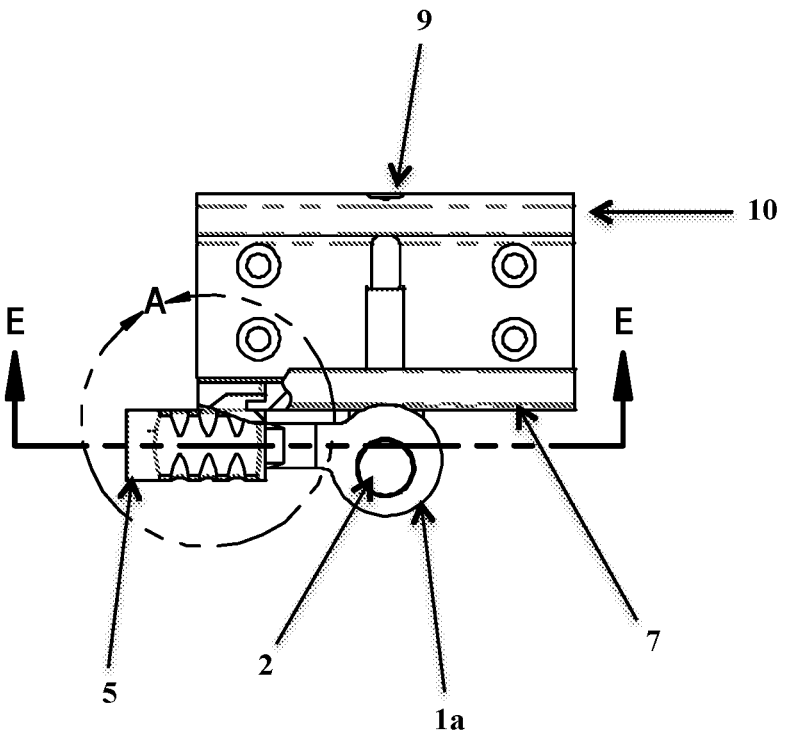
FIG. 6 shows a bottom view of a quick release mounting system according to certain embodiments of the invention and a mount for a firearm 10.

FIG. 6 shows a bottom view of a quick release mechanism according to certain embodiments of the invention and a mount for a firearm 10. Shown are a cam-portion 1*a* and a pivot 2 that fits in the cam-cutout of the cam-portion 1*a*. A latch 5 is shown with the arm-portion 1*b* of the cam-lever 1 inside the inner cavity of the latch 5. The latch 5 is in a locked position so that the quick release mechanism would be attached to a rail between the mount 10 and the clamp 7. A clamp 7 is shown. A tension screw 9 extends through the mount 10 and the clamp 7, and between the upper and lower cam of the cam-portion 1*a* and into an opening in the pivot 2.

Figure 7:
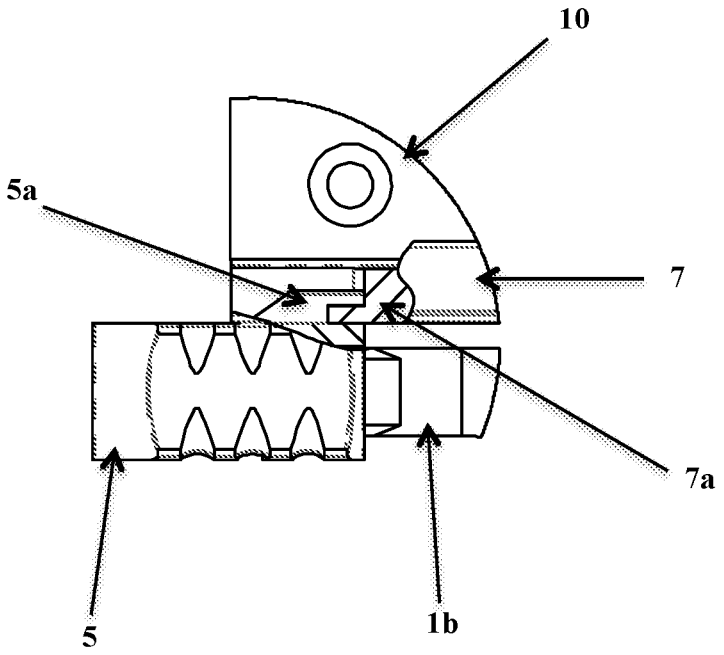
FIG. 7 shows the callout in circle A in FIG. 6.

FIG. 7 shows the callout in circle A in FIG. 6. Shown is a latch 5 and an arm-portion 1*b* of a cam-lever extending into an inner cavity of the latch 5. A finger 5*a* of the latch 5 holds onto a clamp cut-out 7*a* of a clamp 7. Also shown is a mount for a firearm 10.

Figure 8:
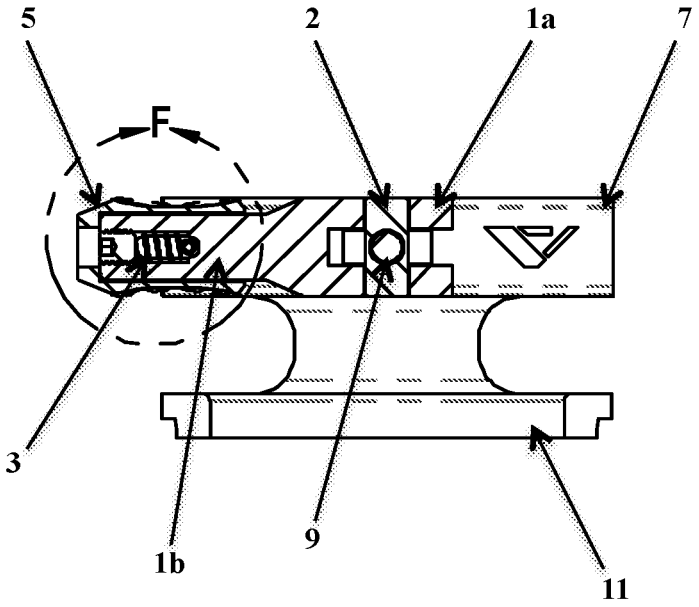
FIG. 8 shows the view along line E-E in FIG. 6, including a cross-sectional view shown with diagonal shading and a side view without shading.

FIG. 8 shows the view along line E-E in FIG. 6, including a cross-sectional view shown with diagonal shading and a side view without shading. Shown are a cam-portion 1*a* and an arm-portion 1*b* of a cam-lever 1, with a pivot 2 fit in the cam-cutout of the cam-portion 1*a*. A spring 3 fits inside an inner cavity of the arm-portion 1*b*. A latch 5 is shown with the arm-portion 1*b* inside the inner cavity of the latch 5. A clamp 7 is shown and the clamp 7 is held to the cam-portion 1*a* with a tension screw 9, which extends through an opening in the clamp 7, between the upper and lower cam of the cam-portion 1*a*, and into an opening in the pivot 2. Also shown is a mount for a firearm 11.

Figure 9:
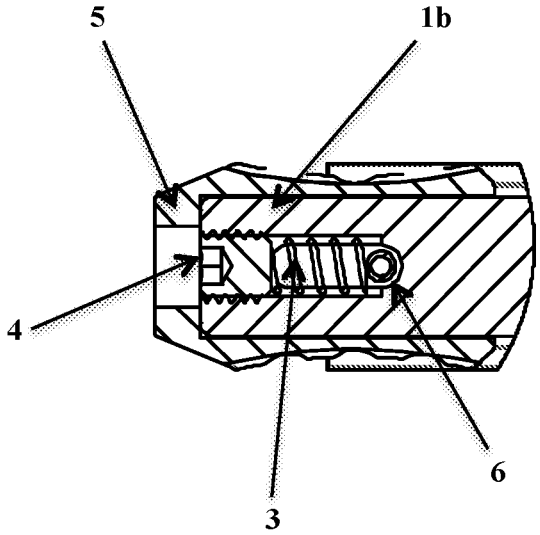
FIG. 9 shows the callout in circle F in FIG. 8.

FIG. 9 shows the callout in circle F in FIG. 8. Shown are an arm-portion 1*b* of a cam-lever 1 and a spring 3 inside an inner cavity of the arm-portion 1*b*. The inner cavity of each arm-portion 1*b* is closed with a set screw 4. A latch 5 is shown with the arm-portion 1*b* inside the inner cavity of the latch 5. A pin 6 is shown that fits through lateral openings of the latch 5 and through lateral slots in the arm-portion 1*b*. When the latch 5 is pulled away from the arm-portion 1*b*, the pin 6 presses against the spring 3, which builds spring force that counteracts the pulling force.

FIG. 10 shows a bottom view of a quick release mechanism according to certain embodiments of the invention, with parts of the clamp 7 not shown to reveal the interaction of the latch 5 with the clamp 7, and a mount for a firearm 10. Shown are a cam-portion 1*a* and a pivot 2 that fits in the cam-cutout of the cam-portion 1*a*. A latch 5 is shown with the arm-portion 1*b* of the cam-lever 1 inside the inner cavity of the latch 5. A clamp 7 is shown. A tension screw 9 extends through the mount 10 and the clamp 7, and between the upper and lower cam of the cam-portion 1*a* and into an opening in the pivot 2. The latch 5 is in an unlocked position because pulling force is applied to the latch 5 (as indicated by the arrow), which is counteracted by a spring (not shown) in an inner cavity of the arm-portion 1*b*, so that the spring force results in a bias towards a locked position of the latch 5. In the unlocked position, the latch 5 and the cam-lever 1 (comprising the cam-portion 1*a* and the arm-portion 1*b*) can be rotated around the pivot 2, whereby the distance shown as X1 is varied, which results in locking (when X1 is small) and unlocking (when X1 is large). In the rotational state of the cam-lever 1 that is shown in FIG. 10, the distance shown as X1 is in a locking configuration.

FIG. 11 shows the callout in circle B in FIG. 10. Shown are an arm-portion 1*b* partially inside the inner cavity of a latch 5. The latch 5 is in an unhooked position because a finger 5*a* of the latch 5 does not reach behind the wall of a clamp cut-out 7*a* of a clamp 7. As the latch 5 is in an unlocked position, the cam-lever 1 comprising the arm-portion 1*b* and the latch 5 can be rotated about 180 degrees next to the clamp 7 and the mount 10.

Figure 12:
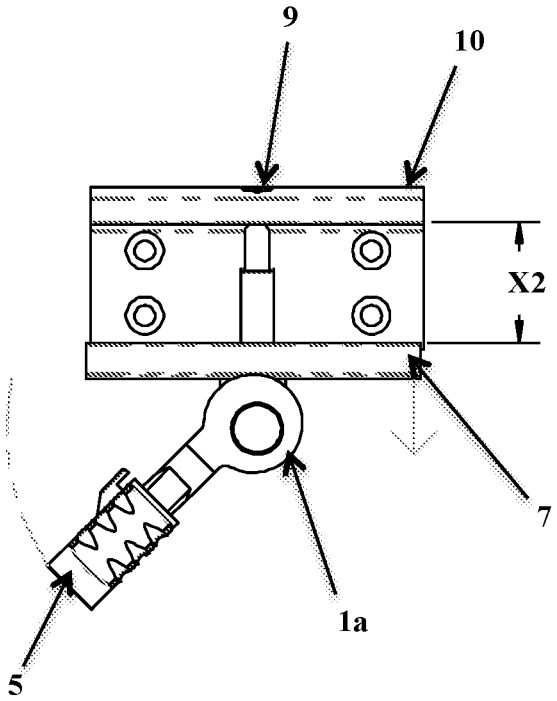
Figure 13:
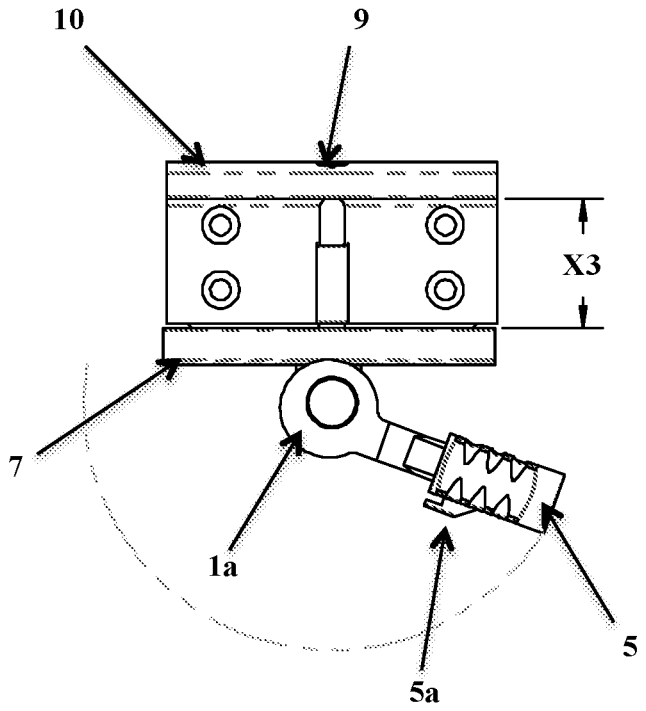

FIGS. 12-13 show bottom views of the quick release mechanism shown in FIG. 10. Shown are a cam-portion 1*a* and a latch 5 on the arm-portion 1*b* connected to the cam-portion 1*a*. Also shown are a tension screw 9, a mount 10 and a clamp 7. In FIG. 12, the cam-portion 1*a* is rotated by about 45 degrees away from the locked position shown in FIG. 10, so that the distance shown as X2 in FIG. 12 is larger than the corresponding distance shown as X1 in FIG. 10. In FIG. 13, the cam-portion 1*a* is rotated by about 150 degrees away from the locked position shown in FIG. 10, so that the distance shown as X3 in FIG. 13 is larger than the corresponding distance shown as X2 in FIG. 12 and X1 in FIG. 10.

Figure 14:
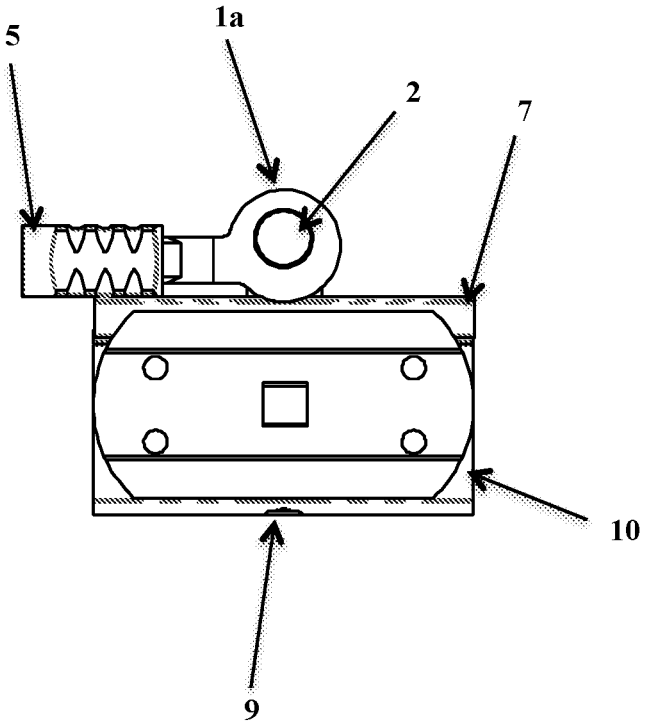
Figure 15:
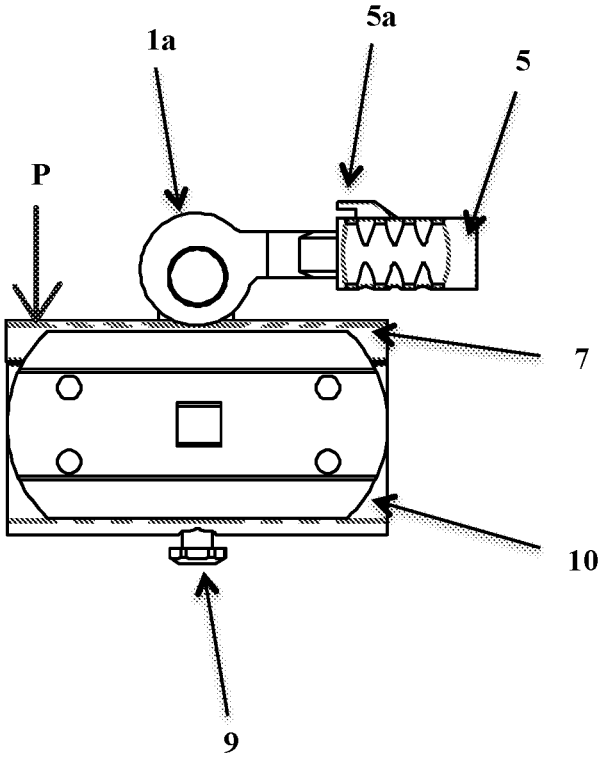

FIGS. 14-15 show bottom views of a quick release mechanism according to certain embodiments of the invention and a mount for a firearm 10. Shown are a cam-portion 1*a*, a pivot 2, a latch 5, and a finger 5*a*. Also shown are a tension screw 9, a mount 10 and a clamp 7. FIGS. 14 and 15 illustrate the adjustment of spring force of clamp springs 8 (which are not visible in FIGS. 14 and 15, but are exemplified in FIGS. 1, 2, and 4) with the tension screw 9. The cam-portion 1*a* is rotated from a locked configuration (shown in FIG. 14) to an unlocked configuration (shown in FIG. 15). Pressure is applied on the clamp 7 (illustrated in FIG. 15 by an arrow and designated as P) so that the tension screw 9 extends beyond the mount 10 for adjustment by rotation of the tension screw 9 to increase or decrease tension in one or more clamp springs 8.

FIG. 16 shows parts of a quick release mechanism according to certain embodiments of the invention, when seen as emerging from behind a mount for a firearm 10. Shown are a latch 5, a mount for a firearm 10, a cut-out 10*a*, and a tension screw 9.

FIG. 17 shows the cross-sectional view along line D-D in FIG. 16, including a mount for a firearm (10 and 11). Shown are a cam-portion 1*a* on both sides of a pivot 2, which is inside a cam cut-out of the cam-portion 1*a*; the cam-portion 1*a* can rotate around the pivot 2 (unless the cam-lever 1 is in a locked configuration). Also shown are a clamping-edge 7*b*, a mount for a firearm accessory (10 and 11), and a tension screw 9 that extends through the mount 10, through the cam-portion 1*a*, and connects into an opening in the pivot 2 (for example, by a threaded connection).

FIG. 18 shows the callout in circle C in FIG. 16. Shown are a mount for a firearm 10, a cut-out 10*a* in the mount 10, and a tension screw 9. In certain embodiments, the cut-out 10*a* is a twelve-sided cut-out in which the head of the tension screw 9 can rest and which prohibits rotation of the tension screw 9, so that the head of tension screw 9 must be elevated out of the cut-out 10*a* to allow rotation of the tension screw 9. The arched arrows illustrate rotation of the tension screw 9, for example to adjust the spring force of a clamp spring 8 (not shown).

FIG. 19 shows a section of a mount for a firearm 10 for use with a quick release mechanism according to certain embodiments of the invention. Also shown is cut-out 10*a* for holding the head of a tension screw 9 (not shown).

In certain embodiments, a method of the current invention comprises one or more of the following steps. In certain embodiments, a method of the invention comprises attaching a clamping-object to a firearm by attaching a quick release mechanism of the current invention to the clamping-object. In certain embodiments, a method of the invention comprises attaching a quick release mechanism of the current invention and a clamping-object to a firearm by attaching the quick release mechanism and the clamping-object to the firearm. In certain embodiments, a method of the invention comprises attaching an accessory to a firearm by attaching a quick release mechanism of the current invention to the accessory. In certain embodiments, a method of the invention comprises attaching a quick release mechanism of the current invention and an accessory to a firearm by attaching the quick release mechanism and the accessory to the firearm.

In certain embodiments, a method of the invention comprises rotating a cam-lever of the current invention, locking a latch of the current invention, unlocking a latch of the current invention, and/or adjusting a tension screw of the current invention.

In certain embodiments, a method of the current invention comprises one or more of the following steps. In certain embodiments, a method of the invention comprises attaching an accessory to a quick release mechanism according to the current invention. In certain embodiments, a method of the invention comprises implementing a quick release mechanism of the current invention on a firearms accessory.

In certain embodiments, a method of the invention comprises removing a clamping-object from a quick release mechanism of the current invention. In certain embodiments, a method of the invention comprises removing a clamping-object from a quick release mechanism of the current invention by unlocking a latch of the current invention and/or by rotating a cam-lever of the current invention.

A quick release mechanism according to the current invention, in certain embodiments, may be implemented on any firearms accessory, for example, a scope, a sight, a light, a laser, a launcher, a bipod, a grip, and any other accessories.

The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited publications, patents, and patent applications are herein incorporated by reference in their entirety for any purpose.

What is claimed is:

1. A quick release mechanism for a firearm accessory comprising a cam-lever, a pivot, a latch, a clamp, a clamp spring, and a tension screw; wherein said cam-lever comprises a cam-portion and an arm-portion; wherein said cam-portion comprises a cam cut-out; wherein said pivot fits inside the cam cut-out; wherein the latch is located on the arm-portion of the cam-lever; wherein the latch comprises an opening; wherein the arm-portion is inserted into the opening of the latch; wherein the latch is movable relative to the cam-lever; wherein an elastic force biases the latch towards the cam-lever; wherein said elastic force is created by a spring which acts on one or both of a set screw and a pin; wherein the latch comprises a locking mechanism; wherein the latch can be locked into a position wherein the quick release mechanism is not released; and wherein the tension screw is connected to the pivot.

2. A quick release mechanism according to claim 1, wherein the locking mechanism comprises one or more of a finger, a hook, a catch, a fastener, a clip, a snap, a magnet, a button, a staple, a push-button, and a clasp.

3. A quick release mechanism according to claim 1, wherein the locking mechanism is capable of retaining the cam-lever in a position next to the clamp.

4. A quick release mechanism according to claim 1, wherein the locking mechanism is capable of restricting a rotational movement of the cam-lever.

5. A quick release mechanism according to claim 1, wherein the clamp comprises a clamp cut-out; and wherein the locking mechanism is capable of holding onto a wall of the clamp at the clamp cut-out.

6. A quick release mechanism according to claim 1, wherein the tension screw is capable of attaching the mounting system to a mount.

7. A quick release mechanism according to claim 1, wherein the tension screw is capable of attaching the mounting system to a firearm accessory.

8. A quick release mechanism for a firearm accessory comprising a cam-lever, a pivot, a latch, a clamp, a clamp spring, and a tension screw; wherein said cam-lever comprises a cam cut-out; wherein said pivot fits inside the cam cut-out; wherein the latch has an opening and a portion of the cam lever is received in the opening; wherein the latch can be locked into a position wherein the quick release mechanism is not released; wherein an elastic force biases the latch towards the cam-lever; wherein an elastic force biases the latch towards the cam-lever; wherein said elastic force is created by a spring which acts on one or both of a set screw and a pin; and wherein the tension screw is connected to the pivot.

9. A quick release mechanism according to claim 8, wherein the cam-lever comprises a cam-portion and an arm-portion.

10. A quick release mechanism according to claim 9, wherein the cam cut-out is in the cam-portion.

11. A quick release mechanism according to claim 9, wherein the arm-portion is inserted into an opening in the latch.

12. A quick release mechanism according to claim 8, wherein the latch comprises a locking mechanism capable of restricting a movement of the cam-lever.

13. A quick release mechanism according to claim 12, wherein the locking mechanism comprises one or more of a finger, a hook, a catch, a fastener, a clip, a snap, a magnet, a button, a staple, a push-button, and a clasp.

14. A quick release mechanism according to claim 12, wherein the locking mechanism is capable of retaining the cam-lever in a position next to the clamp.

15. A quick release mechanism according to claim 12, wherein the locking mechanism is capable of restricting a rotational movement of the cam-lever.

16. A quick release mechanism according to claim 12, wherein the clamp comprises a clamp cut-out.

17. A quick release mechanism according to claim 16, wherein the locking mechanism is capable of holding onto a wall of the clamp at the clamp cut-out.

18. A quick release mechanism according to claim 8, wherein the tension screw is capable of attaching the mounting system to a mount.

19. A quick release mechanism according to claim 8, wherein the tension screw is capable of attaching the mounting system to a firearm accessory.

* * * * *